US008950303B2

(12) United States Patent
Tsai

(10) Patent No.: US 8,950,303 B2
(45) Date of Patent: Feb. 10, 2015

(54) WEB PRODUCT CUTTING AND SCREENING MACHINE AND METHOD

(71) Applicant: Chan Li Machinery Co., Ltd., Taoyuan (TW)

(72) Inventor: Tung I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 216 days.

(21) Appl. No.: 13/729,283

(22) Filed: Dec. 28, 2012

(65) Prior Publication Data

US 2013/0233137 A1 Sep. 12, 2013

(30) Foreign Application Priority Data

Mar. 6, 2012 (TW) ..... 101107446 A

(51) Int. Cl.
*B26D 7/06* (2006.01)

(52) U.S. Cl.
USPC ..... 83/27; 83/215; 83/112

(58) Field of Classification Search
USPC ..... 83/13, 27, 104, 39, 112, 117, 215, 118, 83/119, 203, 23
See application file for complete search history.

(56) References Cited

U.S. PATENT DOCUMENTS

| | | | | |
|---|---|---|---|---|
| 5,199,341 | A * | 4/1993 | Jones | 83/100 |
| 6,895,843 | B1 * | 5/2005 | Hurdle, Jr. | 83/23 |
| 2005/0247173 | A1 * | 11/2005 | Alsten et al. | 83/13 |
| 2006/0081100 | A1 * | 4/2006 | Fassbind | 83/13 |
| 2007/0006698 | A1 * | 1/2007 | Kurtz | 83/13 |
| 2007/0209492 | A1 * | 9/2007 | Schmid | 83/33 |
| 2009/0000438 | A1 * | 1/2009 | Perini | 83/13 |
| 2010/0186562 | A1 * | 7/2010 | Schaferling | 83/13 |
| 2011/0169217 | A1 * | 7/2011 | Ziegler et al. | 271/278 |
| 2014/0190323 | A1 * | 7/2014 | Khalaf et al. | 83/13 |

* cited by examiner

*Primary Examiner* — Sean Michalski
(74) *Attorney, Agent, or Firm* — Rosenberg, Klein & Lee

(57) ABSTRACT

A web product cutting and screening machine includes a first conveying unit having a first movable roller set, a second conveying unit having a second movable roller set movable relative to the first movable roller set and defining with the first movable roller set a first gap therebetween, and a cutter movable across the first gap to cut off a web product, producing a head cut piece, normal cut pieces and a tail cut piece. During screening operation, the second movable roller set can be moved away from the first movable roller set to screen the heat cut piece and the first movable roller set can be moved away from the second movable roller set to screen the tail cut piece, and therefore the web product cutting and screening efficiency is improved.

17 Claims, 15 Drawing Sheets

WEB PRODUCT CUTTING AND SCREENING MACHINE AND METHOD

BACKGROUND OF THE INVENTION

1. Technical Field

The present invention relates to a web product cutting and screening machine and method for cutting and screening folded or stacked web products.

2. Description of the Prior Art

Commercial toilet paper products, subject to their packing method, can be classified into interfold toilet paper (pop-up toilet paper) type, stacked toilet paper (flat pack toilet paper) type, and toilet paper roll type. Consumers can select toilet paper products subject to their habits or needs.

The processing or fabrication of toilet tissue paper varies with toilet tissue paper stacking status. FIG. 1 illustrates a conventional web product cutting machine. As illustrated, this conventional web product cutting machine 10 comprises a first conveying unit 11, a second conveying unit 13, a cutter 15, a first top conveying unit 17, and a second top conveying unit 19. The first conveying unit 11 and the second conveying unit 13 define therebetween a gap 12. The cutter 15 is disposed above the gap 12.

The first conveying unit 11 is adapted to deliver a stack of toilet tissue paper 14 to the second conveying unit 13. The cutter 15 is movable across the gap 12 to cut off the stack of toilet tissue paper 14 subject to the desired length.

Normally, a toilet paper roll has a fixed shape and can be conveniently cut by the aforesaid conventional web product cutting machine 10. However, when operating the aforesaid conventional web product cutting machine 10 to cut off a stack of flat or interfold toilet tissue paper 14, the variable shape of the flat or interfold toilet tissue paper 14 will cause following some problems. As shown in FIG. 2, the stack of flat or interfold toilet tissue paper 14 consists of multiple flat or interfolded toilet tissue paper sheets 142, and its shape is highly variable.

During operation, the web product cutting machine 10 is controlled to cut the toilet tissue paper 14 into a head cut piece 141, a tail cut piece 143 and multiple normal cut pieces 145. The length L1 of the head cut piece 141 and the length L2 of the tail cut piece 143 are shorter than the length L3 of the normal cut pieces 145. Further, the length L1 of the head cut piece 141 and the length L2 of the tail cut piece 143 may be smaller than the height H of the toilet tissue paper 14. During delivery of the head cut piece 141 and the tail cut piece 143 by the first conveying unit 11 and/or the second conveying unit 13, the head cut piece 141 and the tail cut piece 143 may fall down and can be spread over the first conveying unit 11 and/or the second conveying unit 13, disturbing further screening of the head cut piece 141 and the tail cut piece 143.

To eliminate the aforesaid problem, a toilet web paper manufacturer may pack or wrap the toilet tissue paper 14 before cutting, so that the head cut piece 141 and the tail cut piece 143 can be kept in shape after cutting, avoiding spreading of the head cut piece 141 and the tail cut piece 143 over the first conveying unit 11 and/or the second conveying unit 13. However, packing or wrapping the toilet tissue paper 14 before cutting complicates the fabrication of the toilet tissue paper and relatively increases the manufacturing cost.

Referring to FIG. 3, some manufacturers may control the total length L of each stack of flat or interfold toilet tissue paper 14 to be cut and the length L3 of the desired normal cut pieces 145, keeping the total length L of each stack of flat or interfold toilet tissue paper 14 to be an integer multiple of the length L3 of the desired normal cut pieces 145, and avoiding the production of any head cut piece 141 or tail cut piece 143. After the stack of flat or interfold toilet tissue paper 14 is cut into multiple normal cut pieces 145, the first normal cut piece 147 and the last normal cut piece 149 will have an uncut edge 144 that is not cut by the cutter 15. This uncut edge 144 may cause a poor quality problem, for example, the problem of poor stacking.

Further, the length of the first normal cut piece 147 and the length of the last normal cut piece 149 may be insufficient. If the length of the first normal cut piece 147 or the length of the last normal cut piece 149 are insufficient, the first normal cut piece 147 or the last normal cut piece 149 will be unable to meet the product specifications, increasing the product of waste during fabrication.

SUMMARY OF THE PRESENT INVENTION

It is, therefore, the main object of the present invention to provide a web product cutting and screening machine, which uses a first conveying unit with a first movable roller set and a second conveying unit with a second movable roller set to deliver a web product, and a cutter to cut off the web product in a first gap between the first movable roller set of the first conveying unit and the second movable roller set of the second conveying unit. During the operation of the web product cutting and screening machine, the first movable roller set and the second movable roller set are movable relative to each other to adjust the first gap therebetween, thereby screening the cut pieces of the web product.

Further, each time the web product is cut off, the first movable roller set and the second movable roller set can be selectively moved to one of the positions where the first movable roller set is in the conveying position and the second movable roller set is in a non-conveying position far from the first movable roller set; the first movable roller set and the second movable roller set are in the conveying position; the first movable roller set is in a non-conveying position far from the second movable roller set and the second movable roller set is in the conveying position.

In one embodiment of the present invention, the web product cutting and screening machine further comprises a first top conveying unit spaced above the first conveying unit, and a second top conveying unit spaced above the second conveying unit and defining with the first top conveying unit a second gap in vertical alignment with the first gap for the passing of the cutter. Further, the first top conveying unit defines with the first conveying unit a web product feed port that has a height gradually reducing in direction from the first conveying unit toward the second conveying unit. Thus, the web product, after having been fed into the web product feed port, can be compacted by the first conveying unit and the first top conveying unit, and therefore the rest web product after each cutting will not be spread over the first conveying unit and/or the second conveying unit.

In one embodiment of the present invention, the web product cutting and screening machine further comprises a first sensor unit disposed above the first conveying unit or at one lateral side relative to the first conveying unit and adapted to detect the web product. When the first sensor unit detects the presence of the web product, the conveying speed of the first conveying unit is reduced, facilitating web product length counting and cutting operations.

It is another object of the present invention to provide a web product cutting and screening method used in the aforesaid web product cutting and screening machine to adjust the relative position between the first movable roller set and the second movable roller set, enabling the delivering web product to be cut and the cut pieces of the web product to be screened efficiently.

To achieve these and other objects of the present invention, the present invention provides a web product cutting and screening machine operable to cut off a web product and to screen cut pieces of the web product, comprising: a first conveying unit comprising a first movable roller set, wherein the first movable roller set is movable between a conveying position and a non-conveying position; a second conveying unit comprising a second movable roller set disposed adjacent to the first movable roller set and defining with the first movable roller set a first gap therebetween, wherein the second movable roller set is movable relative to the first movable roller between the conveying position and the non-conveying position, and the web product is delivered from the first movable roller set in the conveying position to the second movable roller set in the conveying position; and a cutter movable to cut off the web product in the first gap, wherein after each cutting operation of the cutter to cut off the web product, the first movable roller set and the second movable roller set are selectively moved to one of the positions where the first movable roller set is in the conveying position and the second movable roller set is in the non-conveying position far from the first movable roller set, the first movable roller set and the second movable roller set are in the conveying position, or the first movable roller set is in the non-conveying position far from the second movable roller set and the second movable roller set is in the conveying position.

To achieve these and other objects of the present invention, the present invention provides a web product cutting and screening method, comprising the steps of: moving a first movable roller set and a second movable roller set to a conveying position and enabling a web product to be delivered by the first movable roller set onto the second movable roller set over a first gap between the first movable roller set and the second movable roller set; cutting off the web product in the first gap to produce a first cut piece; moving the second movable roller set from the conveying position to a non-conveying position far from the first movable roller set for enabling the first cut piece to fall through the first gap; moving the second movable roller set back to the conveying position and keeping the first movable roller set in the conveying position for enabling the web product to be delivered by the first movable roller set over the first gap onto the second conveying unit; cutting off the web product in the first gap during delivery of the web product by the first movable roller set over the first gap onto the second movable roller set to produce at least one second cut piece and a third cut piece; and moving the first movable roller set from the conveying position to a non-conveying position far from the second movable roller set for enabling the third cut piece to fall through the first gap.

In one embodiment of the web product cutting and screening machine, wherein the cutter is movable to cut off the web product in the first gap to produce a head cut piece, and the first movable roller set is kept in the conveying position and the second movable roller set is moved from the conveying position to the non-conveying position to increase the width of the first gap after the production of the head cut piece, enabling the head cut piece to fall through the first gap.

In one embodiment of the web product cutting and screening machine, wherein the cutter is movable to cut off the web product in the first gap to produce a tail cut piece, and the first movable roller set is moved from the conveying position to the non-conveying position and the second movable roller set is kept in the conveying position to increase the width of the first gap after the production of the tail cut piece, enabling the tail cut piece to fall through the first gap.

In one embodiment of the web product cutting and screening machine, wherein the cutter is movable to cut off the web product in the first gap to produce at least one normal cut piece, and the first movable roller set and the second movable roller set are kept in the conveying position.

In one embodiment of the web product cutting and screening machine, further comprising a first top conveying unit spaced above the first conveying unit, and a second top conveying unit spaced above the second conveying unit, wherein a second gap is defined between the first top conveying unit and the second top conveying unit.

In one embodiment of the web product cutting and screening machine, further comprising a web product feed port between the first top conveying unit and the first conveying unit, wherein the web product feed port has a height gradually reducing in direction from the first conveying unit toward the second conveying unit.

In one embodiment of the web product cutting and screening machine, further comprising a first sensor unit adapted to detect the web product on the first conveying unit and to control the first conveying unit to reduce the conveying speed upon detection of the web product in the first conveying unit.

In one embodiment of the web product cutting and screening machine, further comprising a second sensor unit adapted to define a start point of the web product and to count the length of the web product passing by.

In one embodiment of the web product cutting and screening machine, further comprising a waste collection unit spaced below the first gap and adapted to collect a head cut piece and a tail cut piece cut from the web product by the cutter.

In one embodiment of the web product cutting and screening method, wherein first cut piece is a head cut piece that is a waste piece obtained from a leading part of the web product.

In one embodiment of the web product cutting and screening method, wherein the third cut piece is a tail cut piece that is a waste piece obtained from a tail end of the web product.

In one embodiment of the web product cutting and screening method, wherein each the second cut piece is a normal cut piece delivered by the first movable roller set over the first gap onto the second movable roller set and conveyed by the second movable roller set.

In one embodiment of the web product cutting and screening method, further comprising the step of moving the second movable roller set toward the first movable roller set to reduce the width of the first gap after falling of the first cut piece through the first gap.

In one embodiment of the web product cutting and screening method, further comprising the step of moving the first movable roller set back to the conveying position after falling of the third cut piece through the first gap.

In one embodiment of the web product cutting and screening method, further comprising the step of using a first sensor unit to detect passing of the web product and to control the first movable roller set to reduce the conveying speed.

In one embodiment of the web product cutting and screening method, further comprising the step of using a second sensor unit to detect passing of the web product, to define a start point of the web product, to count the length of the web product passing by, and to control the operation of cutting the web product subject to the counting result.

DETAILED DESCRIPTION OF THE PREFERRED EMBODIMENTS

In the following description of the preferred embodiment of the present invention, it is to be noted that the word of "connection" means direct or indirect connection between or among objects or components, for example, an intermediate connecting member or multiple intermediate connecting members can be set between two or multiple objects or components.

Figure 1:
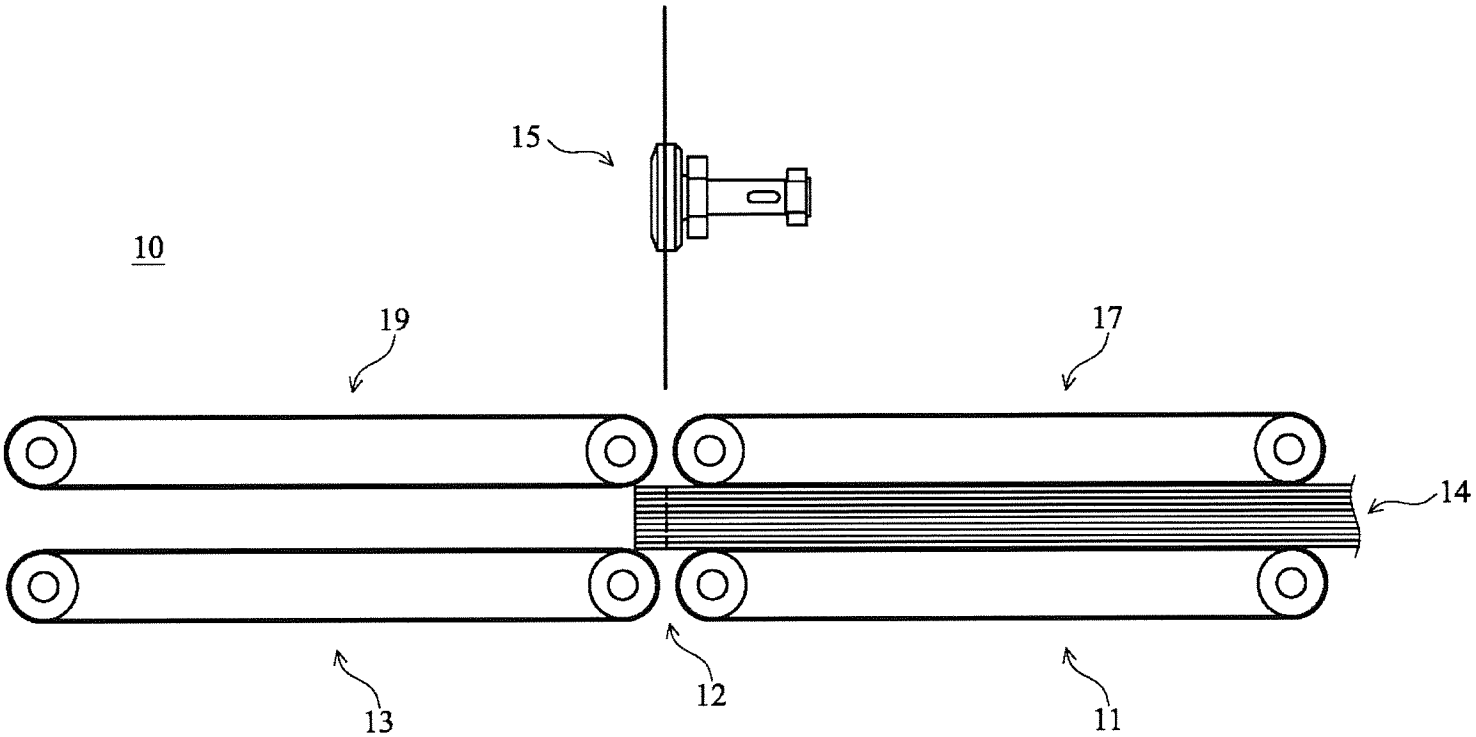
FIG.1 (PRIOR ART)
FIG. 1 is a schematic structural view of a web product cutting machine according to the prior art.
Figure 2:
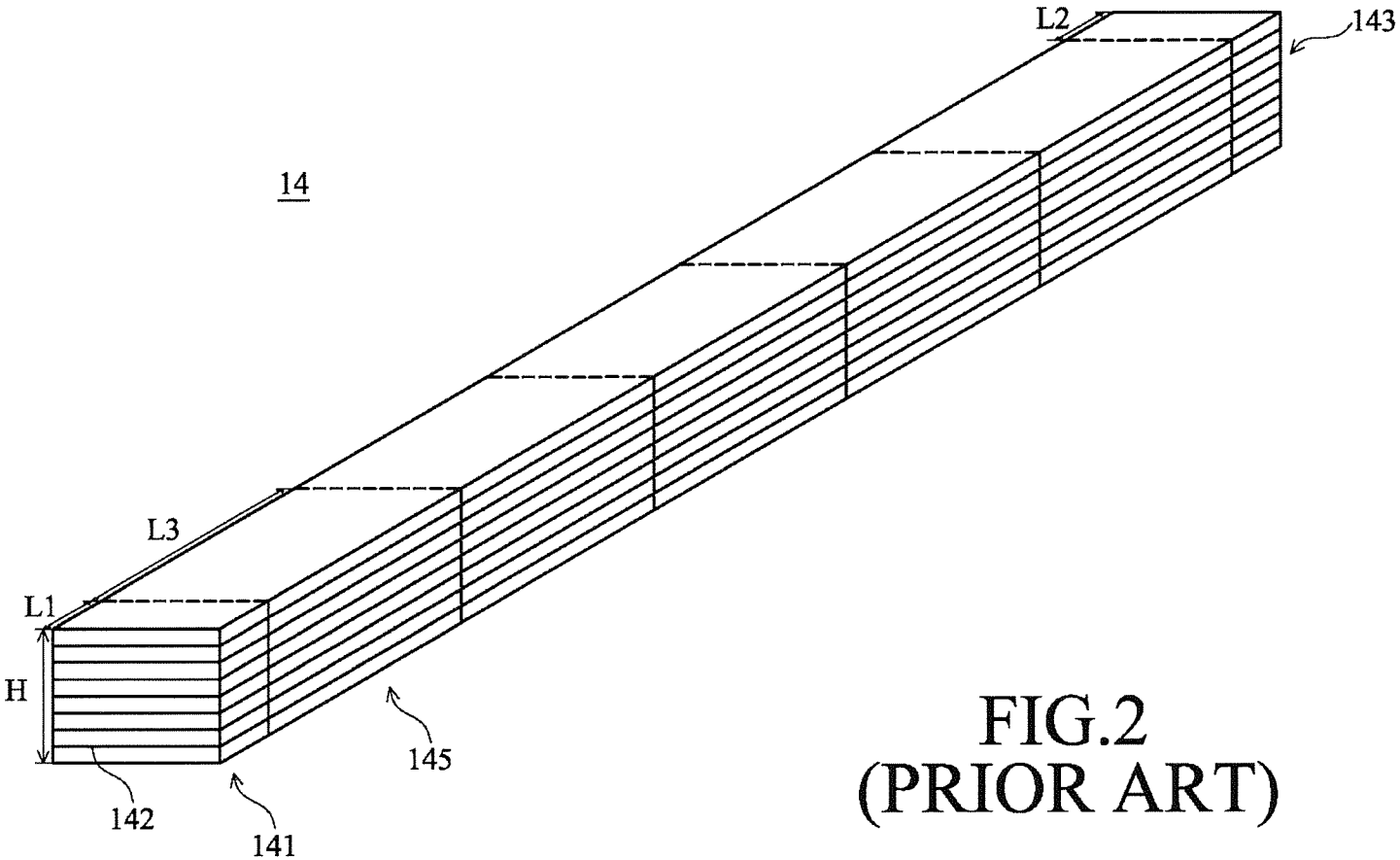
FIG.2 (PRIOR ART)
FIG. 2 is a schematic drawing illustrating a web product cutting example according to the prior art.
Figure 3:
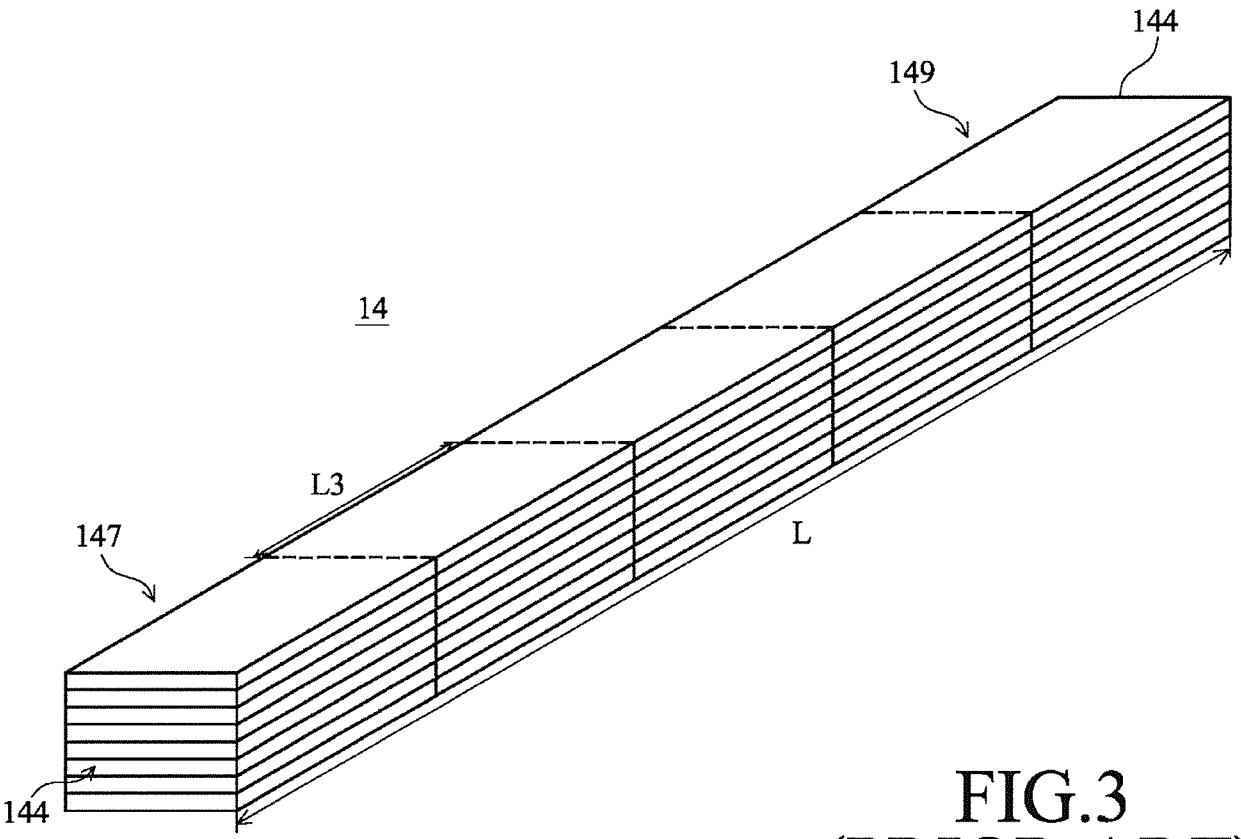
FIG.3 (PRIOR ART)
FIG. 3 is a schematic drawing illustrating another web product cutting example according to the prior art.
Figure 4:
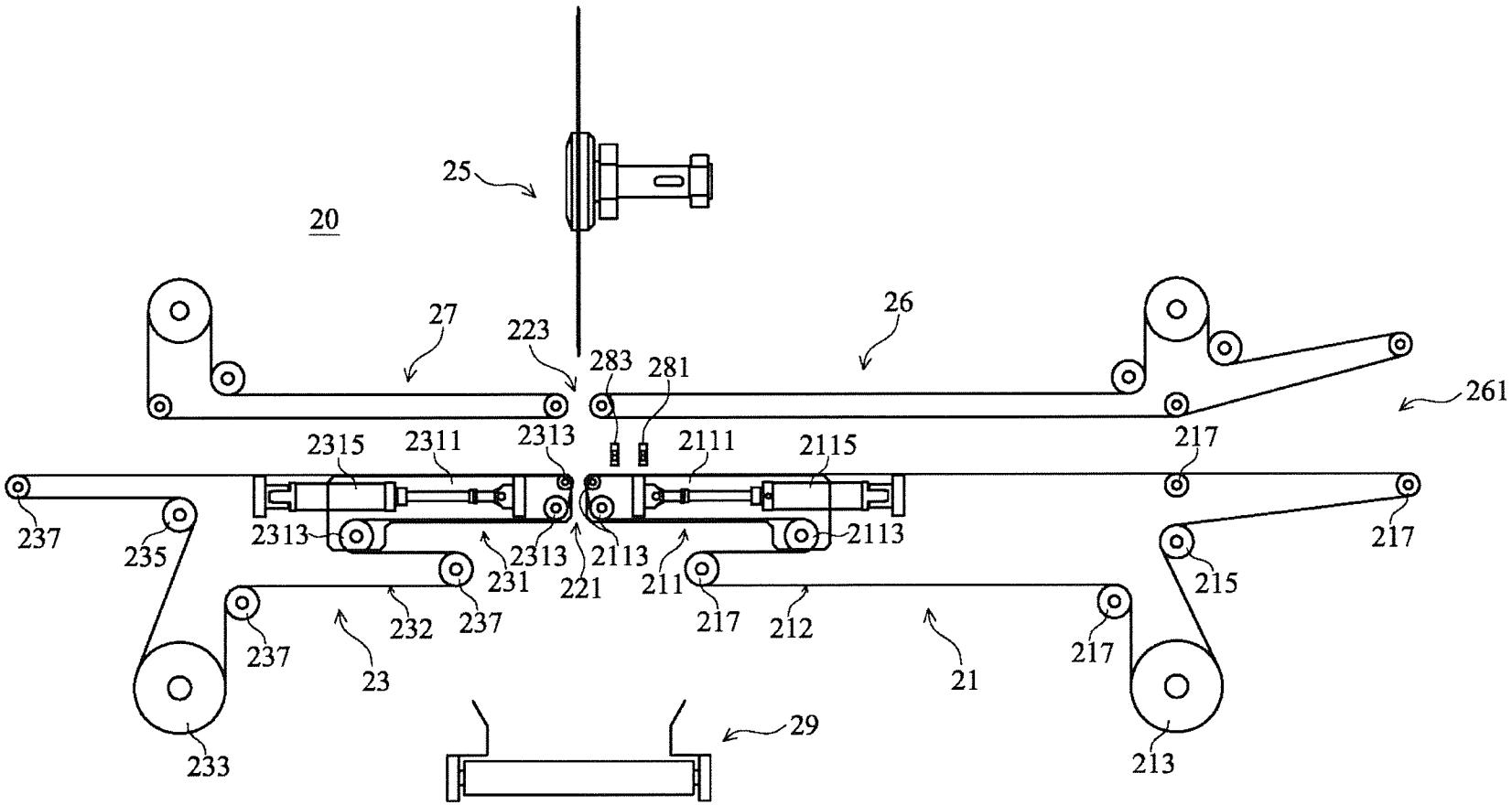
FIG. 4 is a schematic structural view of a web product cutting and screening machine in accordance with the present invention.

Referring to FIG. 4, a web product cutting-folding machine in accordance with the present invention is shown. As illustrated, the web product cutting and screening machine 20 is adapted for cutting and screening a web product 24, comprising a first conveying unit 21, a second conveying unit 23, and a cutter 25, wherein a first gap 221 is defined between the first conveying unit 21 and the second conveying unit 23. The cutter 25 can be disposed at the top side or one lateral side relative to the gap 221, and controlled to cut off the web product 24 in the first gap 221. The first conveying unit 21 and the second conveying unit 23 have movable components that can be moved to adjust the size of the first gap 221, thereby screening the cut pieces of the web product 24.

The first conveying unit 21 and the second conveying unit 23 are adapted to convey the web product 24 and cut pieces of the web product 24. The first conveying unit 21 can convey the web product 24 over the first gap 221 to the second conveying unit 23.

In one embodiment of the present invention, the first conveying unit 21 comprises a first movable roller set 211, and the second conveying unit 23 comprises a second movable roller set 231. The first movable roller set 211 and the second movable roller set 231 are disposed adjacent to each other with the first gap 221 defined therebetween. By means of adjusting the position of the first movable roller set 211 and the position of the second movable roller set 231, the size of the first gap 221 is relatively adjusted for screening the cut pieces of the web product 24.

After cutting of the web product 24, the first movable roller set 211 and second movable roller set 231 of the web product cutting and screening machine 20 may be in one of the following conditions: the first conveying unit 211 is in the conveying position and the second movable roller set 231 is in a position far from the first movable roller set 211; the first movable roller set 211 and the second movable roller set 231 are both in the conveying position; the second movable roller set 231 is in the conveying position and the first movable roller set 211 is in a position far from the second movable roller set 231.

When the first movable roller set 211 and the second movable roller set 231 are both in the conveying position, the web product 24 can be conveyed by the first movable roller set 211 over the first gap 221 onto the second movable roller set 231. The cutter 25 can be controlled to cut off the web product 24 when the web product 24 is being moved over the first gap 221.

When the first movable roller set 211 is in the conveying position and the second movable roller set 231 is retreated to the position far from the first movable roller set 211, the first gap 221 between the first movable roller set 211 and the second movable roller set 231 is increased, enabling each first-size cut piece of the web product 24 to fall through the first gap 221. When the first movable roller set 211 is retreated from the conveying position to a position far from the second movable roller set 231 and the second movable roller set 231 is maintained in the conveying position, the first gap 221 between the first movable roller set 211 and the second movable roller set 231 is also increased, enabling each second-size cut piece of the web product 24 to fall through the first gap 221. By means of relative displacement between the first movable roller set 211 and the second movable roller set 231 to adjust the size of the first gap 221, cut pieces of the web product 24 is screened. The detailed web product cutting and screening operations will be explained latter.

In one embodiment of the present invention, the first movable roller set 211 comprises a first holder frame 2111, at least one first roller 2113, and at least one first driving unit 2115. The at least one first roller 2113 is mounted at the first holder frame 2111. The at least one first driving unit 2115 is connected to the first holder frame 2111 and controllable to move the first holder frame 2111 and the at least one first roller 2113. The second movable roller set 231 comprises a second holder frame 2311, at least one second roller 2313, and at least one second driving unit 2315. The at least one second roller 2313 is mounted at the second holder frame 2311. The at least one second driving unit 2315 is connected to the second holder frame 2311 and controllable to move the second holder frame 2311 and the at least one second roller 2113. Through the aforesaid architecture, the first movable roller set 231 and the second movable roller set 231 can be moved relative to each other to screen different sizes of cut pieces of the web product 24.

Figure 5:
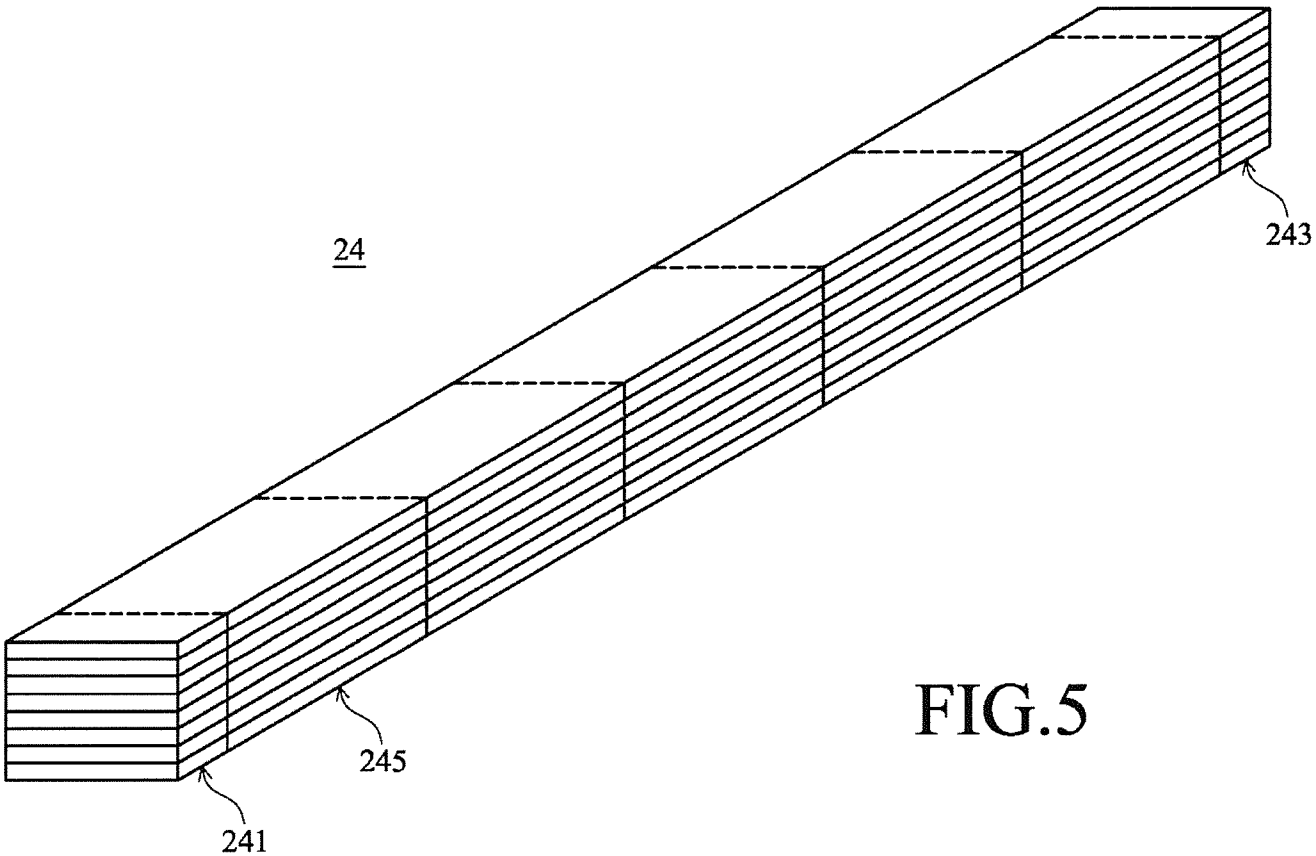
FIG. 5 is a schematic drawing illustrating a web product cut by the web product cutting and screen machine in accordance with the present invention.

Referring also to FIG. 5, after each cutting of the web product 24 by the cutter 25, a head cut piece (a first cut piece) 241, a tail cut piece (a third cut piece) 243 or a normal cut piece (a second cut piece) 245 can be obtained. When a head cut piece 241 is obtained after a movement of the cutter 25 across the web product 24, the first movable roller set 211 can be maintained in the conveying position, and the second movable roller set 231 can be retreated along, for example, the web product conveying direction, to the position far from the first movable roller set 211, thereby increasing the width of the first gap 221 for enabling the head cut piece 241 to fall through the first gap 221.

When a normal cut piece 245 is obtained after a movement of the cutter 25 across the web product 24, the first movable roller set 211 and the second movable roller set 231 can be kept in the conveying position, for example, the second movable roller set 231 can be moved toward the first movable roller set 231, thereby reducing the width of the first gap 221 for enabling the head cut piece 241 to be moved over the first gap 221 to the second movable roller set 231.

When a tail cut piece 243 is obtained after a movement of the cutter 25 across the web product 24, the first movable roller set 211 can be retreated along, for example, the reversed direction relative to the web product conveying direction, to a position far from the second movable roller set 231, thereby increasing the width of the first gap 221 for enabling the head cut piece 241 to fall through the first gap 221.

In one embodiment of the present invention, the first conveying unit 21, in addition to the first movable roller set 211, further comprises a first power wheel 213, a first tension pulley 215, a plurality of first fixed pulleys 217, and a first conveying belt 212. The first conveying belt 212 is wound on the first movable roller set 211 (for example, the first roller 2113 of the first movable roller set 211), the first power wheel 213, the first tension pulley 215 and the first fixed pulleys 217. The first power wheel 213 is the main power source of the first conveying unit 21. The first tension pulley 215 is adapted to adjust the tension of the first conveying belt 212. Starting the first power wheel 213 can rotate the first conveying belt 212 to deliver the web product 24.

Relatively, the second conveying unit 23, in addition to the second movable roller set 231, further comprises a second power wheel 233, a second tension pulley 235, a plurality of second fixed pulleys 237, and a second conveying belt 232. The second conveying belt 232 is wound on the second movable roller set 231 (for example, the second roller 2313 of the second movable roller set 231), the second power wheel 233, the second tension pulley 235 and the second fixed pulleys 237. The second power wheel 233 is the main power source of the second conveying unit 23. The second tension pulley 235 is adapted to adjust the tension of the second conveying belt 232. Starting the second power wheel 233 can rotate the second conveying belt 232 to deliver the web product 24.

In one embodiment of the present invention, the web product cutting and screening machine 20 further comprises a first top conveying unit 26 disposed above the first conveying unit 21, and a second top conveying unit 27 disposed above the second conveying unit 23. A second gap 223 is defined between the first top conveying unit 26 and the second top conveying unit 27 in vertical alignment with the first gap 221 for the passing of the cutter 25 to cut off the web product 24.

The first conveying unit 21 and the first top conveying unit 26 are able to clamp the web product 24, avoiding spreading the web product 24 over the first conveying unit 21. The second conveying unit 23 and the second top conveying unit 27 are able to clamp the web product 24 therebetween, avoiding spreading the cut web product 24 over the second conveying unit 23.

A web product feed port 261 is defined between the first conveying unit 21 and the first top conveying unit 26. The web product 24 to be cut can be fed through the web product feed port 261 into the web product cutting and screening machine 20, the web product cutting and screening machine 20 can be controlled to cut the web product 24 and to screen the cut pieces of the web product 24. In one embodiment of the present invention, the web product feed port 261 has a height gradually reducing in the web product conveying direction, for example, the height of the web product feed port 261 reduces gradually in direction from the first conveying unit 21 toward the second conveying unit 23. After feeding of the web product 24 (that can be a pack of flat toilet web paper or interfold toilet web paper) into the web product feed port 261, the web product 24 will be compacted by the first conveying unit 21 and the first top conveying unit 26 to reduce its height, facilitating follow-up cutting step and avoiding spreading of every cut piece (head cut piece 241, tail cut piece 243 or normal cut piece 245) of the web product 24 onto the first conveying unit 21 and/or the second conveying unit 23.

In one embodiment of the present invention, the web product cutting and screening machine 20 further comprises a first sensor unit 281 and/or a second sensor unit 283. The first sensor unit 281 can be disposed above or at one lateral side relative to the first conveying unit 21 to detect the web product 24 being delivered by the first conveying unit 21. When the first sensor unit 281 senses the presence of the web product 24, it gives a signal to the first conveying unit 21 and/or the first top conveying unit 26 to lower the conveying speed, facilitating follow-up web product cutting and length counting steps.

The second sensor unit 283 can be disposed above or at one lateral side relative to the first conveying unit 21 to define a start point of the web product 24 and to count the length of the web product 24 passing by. The cutter 25 can be controlled to cut the web product 24 subject to the counting result provided by the second sensor unit 283, thereby producing a head cut piece 241, a tail cut piece 243, or a normal cut piece 245.

In one embodiment of the present invention, the web product cutting and screening machine 20 further comprises a waste collection unit 29 spaced below the first gap 221 for collecting the head cut piece 241 and the tail cut piece 243 for further waste recycling and processing.

FIGS. 6A-6J illustrate the flow of the application of the web product cutting and screening method in accordance with the present invention. The web product cutting and screening method in accordance with the present invention can be used in the aforesaid web product cutting and screening machine 20 to cut the web product 24 and to screen the cut pieces of the web product 24.

Figure 6A:
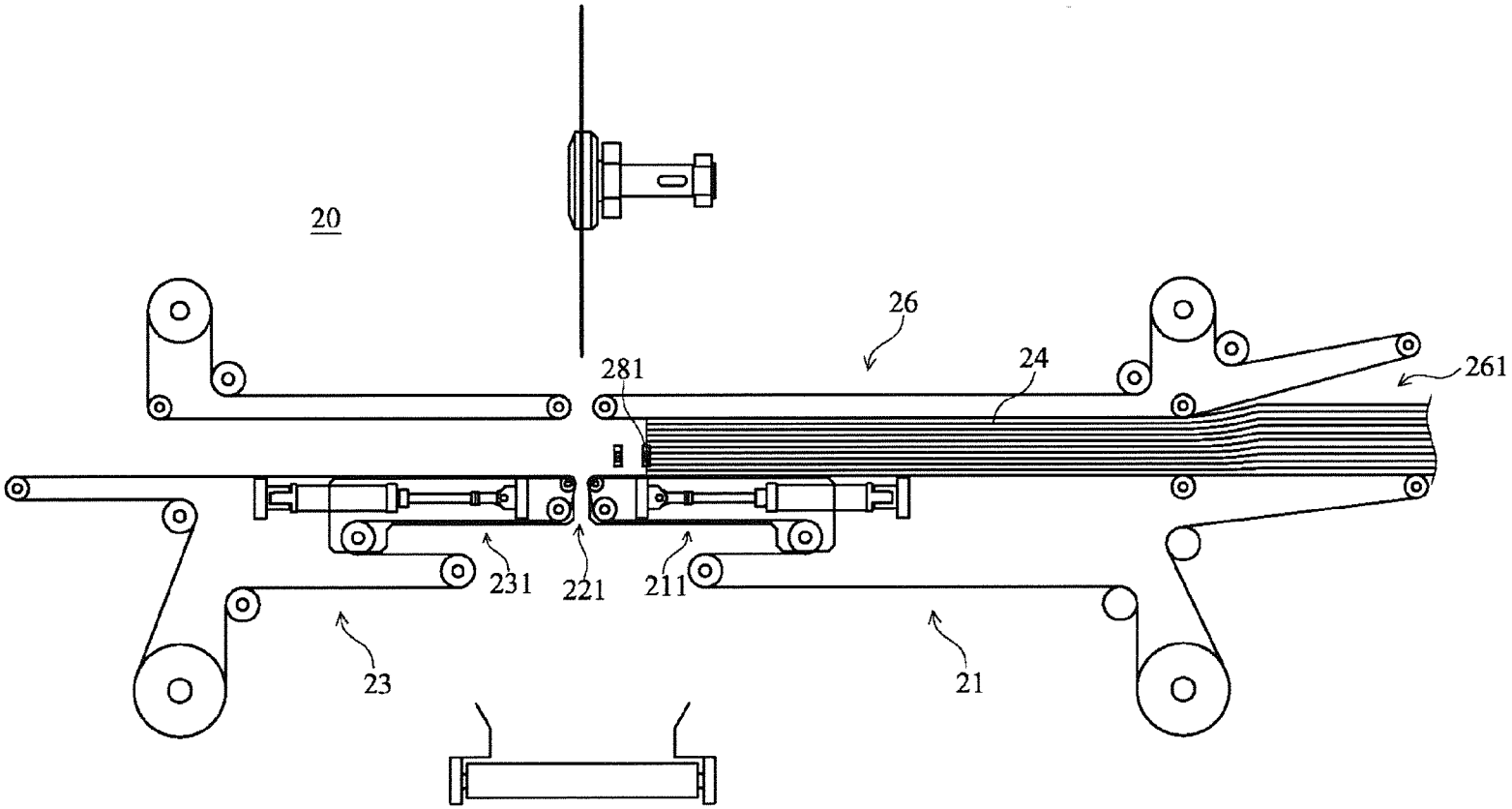
FIGS. 6A-6J illustrate the flow of the application of the web product cutting and screening method in accordance with the present invention.

To facilitate explanation of the present invention, the first movable roller set 211 and the second movable roller set 231 are started from the start point where the first movable roller set 211 and the second movable roller set 231 are both in the conveying position. As shown in FIG. 6A, the first conveying unit 21 is operated to deliver the web product 24 in direction toward the second conveying unit 23. When delivering the web product 24, the first movable roller set 211 and the second movable roller set 231 are both in the conveying position so that the web product 24 can be moved by the first movable roller set 211 over the first gap 221 onto the second movable roller set 231.

In one embodiment of the present invention, a first top conveying unit 26 is disposed above the first conveying unit 21, and a web product feed port 261 is defined between the first conveying unit 21 and the first top conveying unit 26. Further, in this embodiment, the web product feed port 261 has a height gradually reducing in the web product conveying direction, for example, the height of the web product feed port 261 reduces gradually in direction from the first conveying unit 21 toward the second conveying unit 23. After feeding of the web product 24 into the web product feed port 261, the web product 24 can be compacted by the first conveying unit 21 and the first top conveying unit 26 to reduce its height. When the web product 24 reaches the position of the first sensor unit 281 during delivery, the first sensor unit 281 senses the presence of the web product 24 and controls the first conveying unit 21 and/or the first top conveying unit 26 to reduce the conveying speed.

Figure 6B:
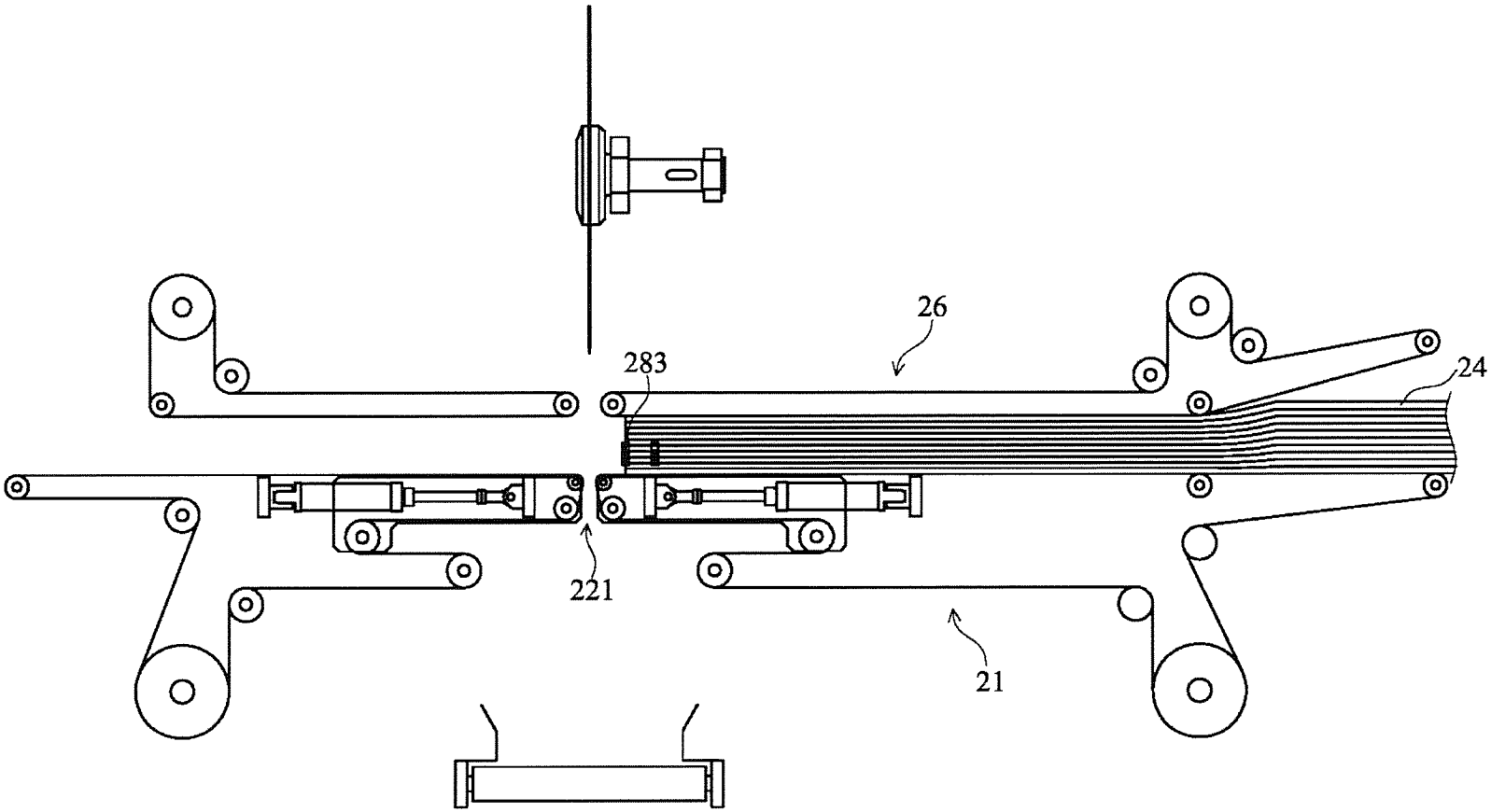

Referring to FIG. 6B, when web product 24 reaches the position of the second sensor unit 283 during delivery by the first conveying unit 21 and/or the first top conveying unit 26, the second sensor unit 283 senses the presence of the web product 24 and defines a start point of the web product 24, and then counts the length of the web product 24 passing by. Normally, the location of the second sensor unit 283 is defined as the start point. The web product 24 is then cut subject to the counted length.

Figure 6C:
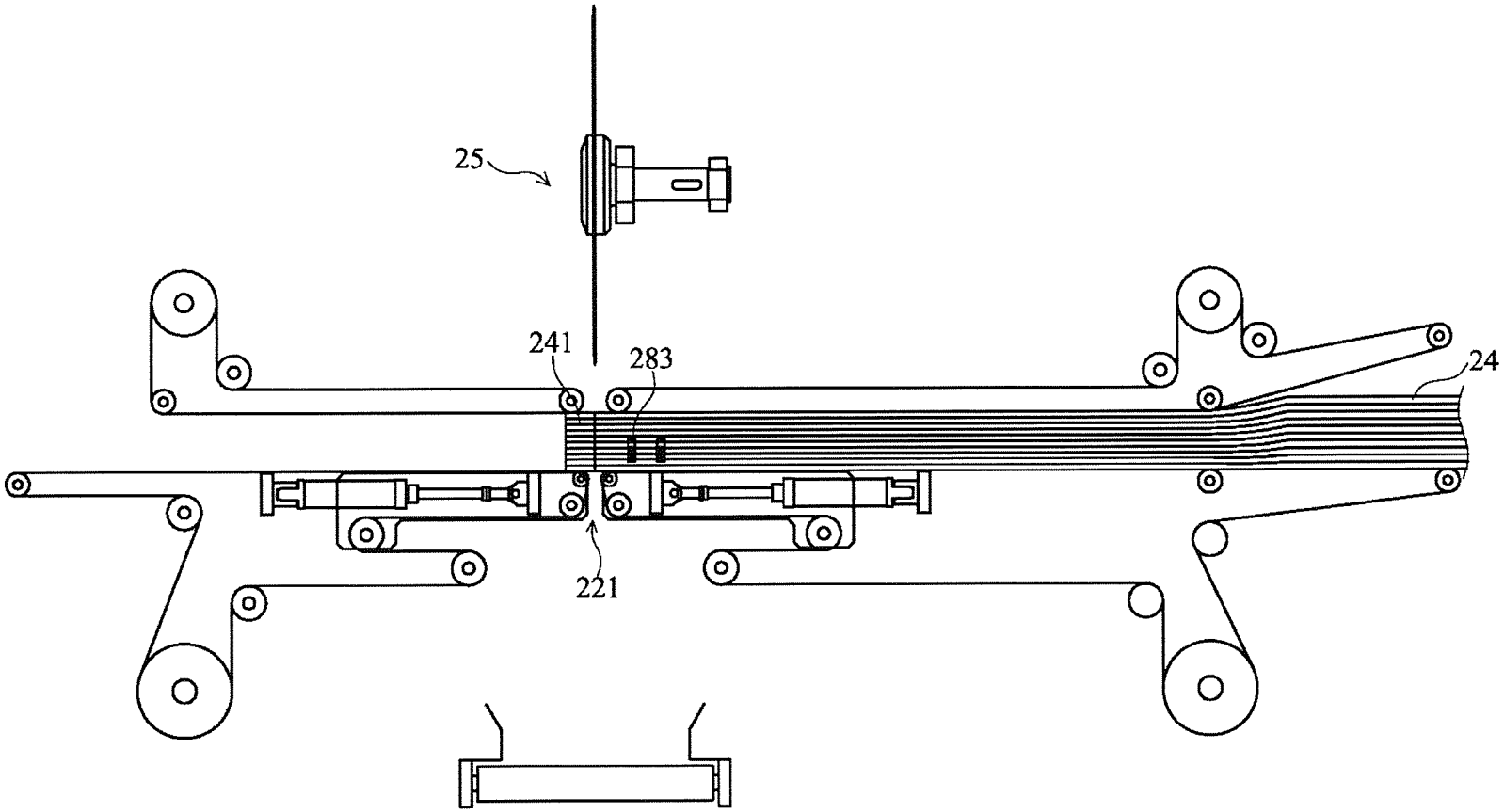

Referring to FIG. 6C, when the length of the web product 24 counted by the second sensor unit 283 reaches a predetermined value, the cutter 25 is controlled to move across the first gap 221, thereby cutting off the web product 24. When the cutter 25 is moved across the web product 24 during this step, a head cut piece 241 is produced.

Figure 6D:
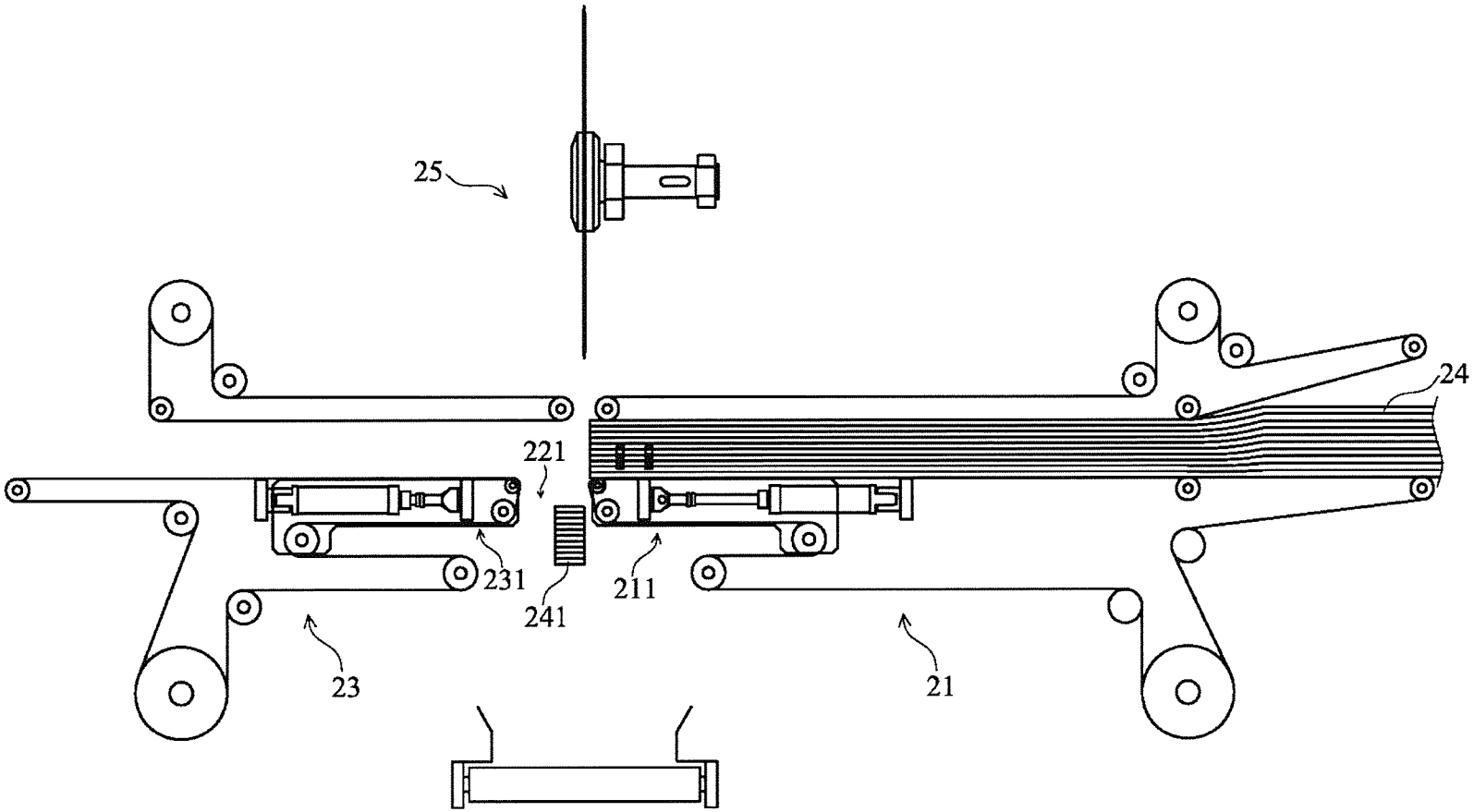

Referring to FIG. 6D, after cutting of the web product 24 by the cutter 25 to produce the head cut piece 241, the second conveying unit 23 and/or the second movable roller set 231 is moved in direction away from the first conveying unit 21 and/or the first movable roller set 211, for example, the second movable roller set 231 is moved in the web product conveying direction to increase the width of the first gap 221, enabling the head cut piece 241 to fall through the first gap 221.

Figure 6E:
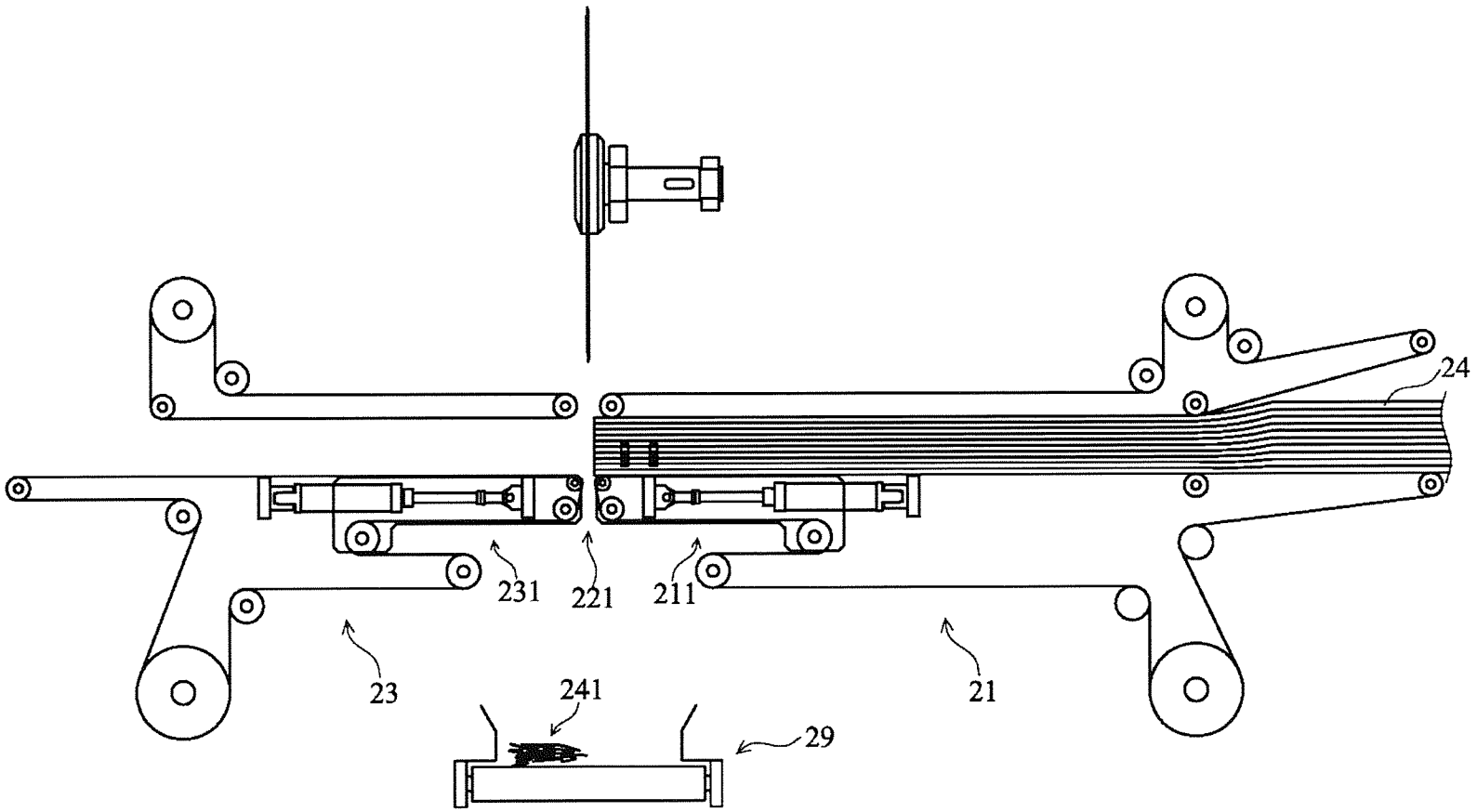

Referring to FIG. 6E, after falling of the head cut piece 241 through the first gap 221, the second conveying unit 23 and/or the second movable roller set 231 are moved toward the first conveying unit 21 and/or the first movable roller set 211 to the conveying position, for example, the second conveying unit 23 and/or the second movable roller set 231 are moved in the reversed direction relative to the conveying direction to reduce the width of the first gap 221. At this time, the first movable roller set 211 and the second movable roller set 231 are in the conveying position, enabling the web product 24 to be moved over the first gap 221 by the first conveying unit 21 onto the second conveying unit 23.

Further, in this embodiment, a waste collection unit 29 is spaced below the first gap 221 to collect the fallen head cut piece 241 for further waste recycling and processing.

Figure 6F:
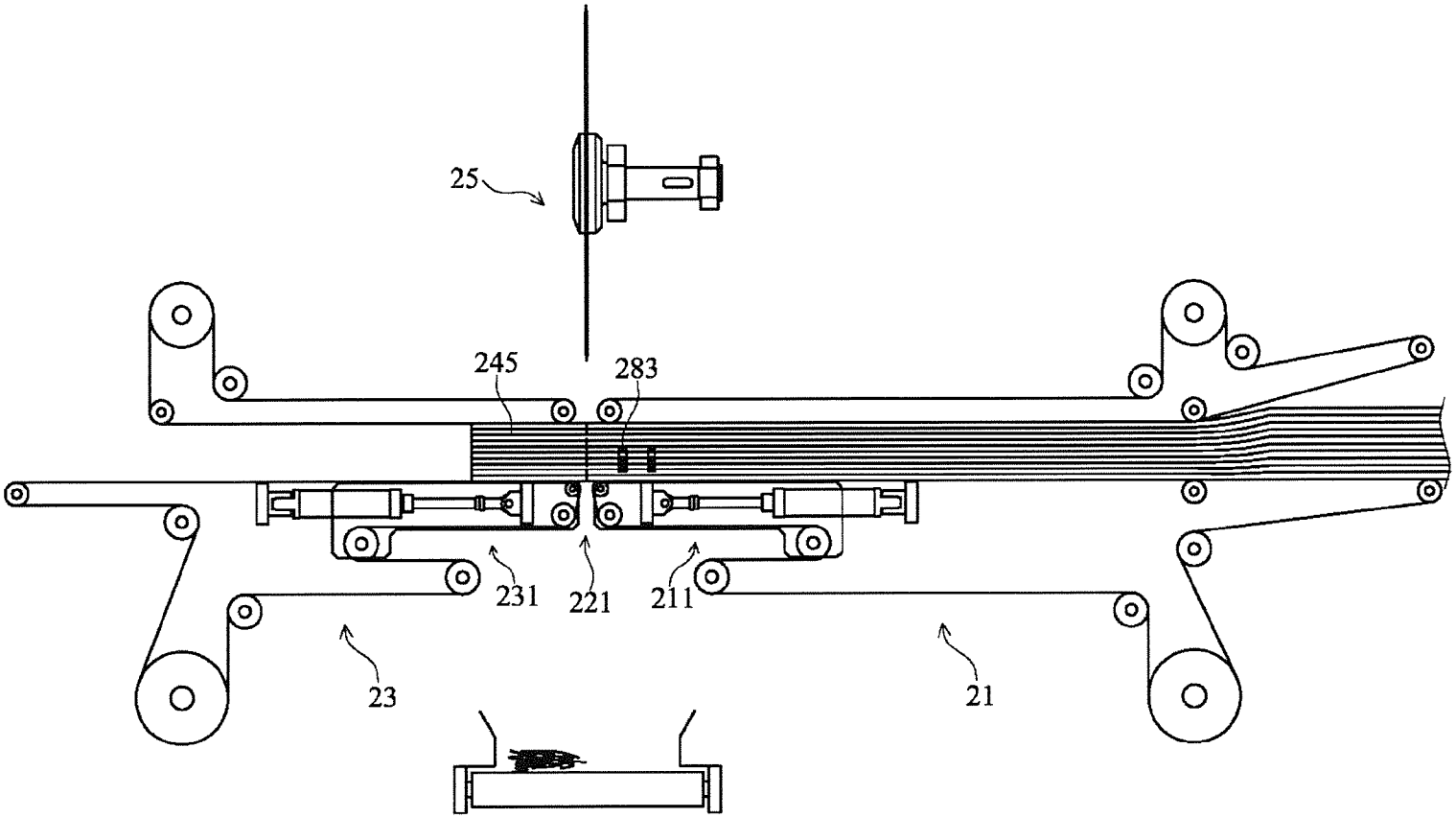

Referring to FIG. 6F, when the length of the web product 24 counted by the second sensor unit 283 reaches the predetermined value, the second sensor unit 283 provides a control signal to move the cutter 25 across the first gap 221 and the web product 24. When the cutter 25 is moved across the web product 24 at this time, a normal cut piece 245 is obtained.

When the normal cut piece 245 is obtained, the first movable roller set 211 and the second movable roller set 231 are kept in the conveying position so that the second conveying unit 23 can deliver the normal cut piece 245. At this time, the rest web product 24 is continuously delivered by the first conveying unit 21 over the first gap 221 onto the second conveying unit 23 and cut by the cutter 25 again.

Figure 6G:
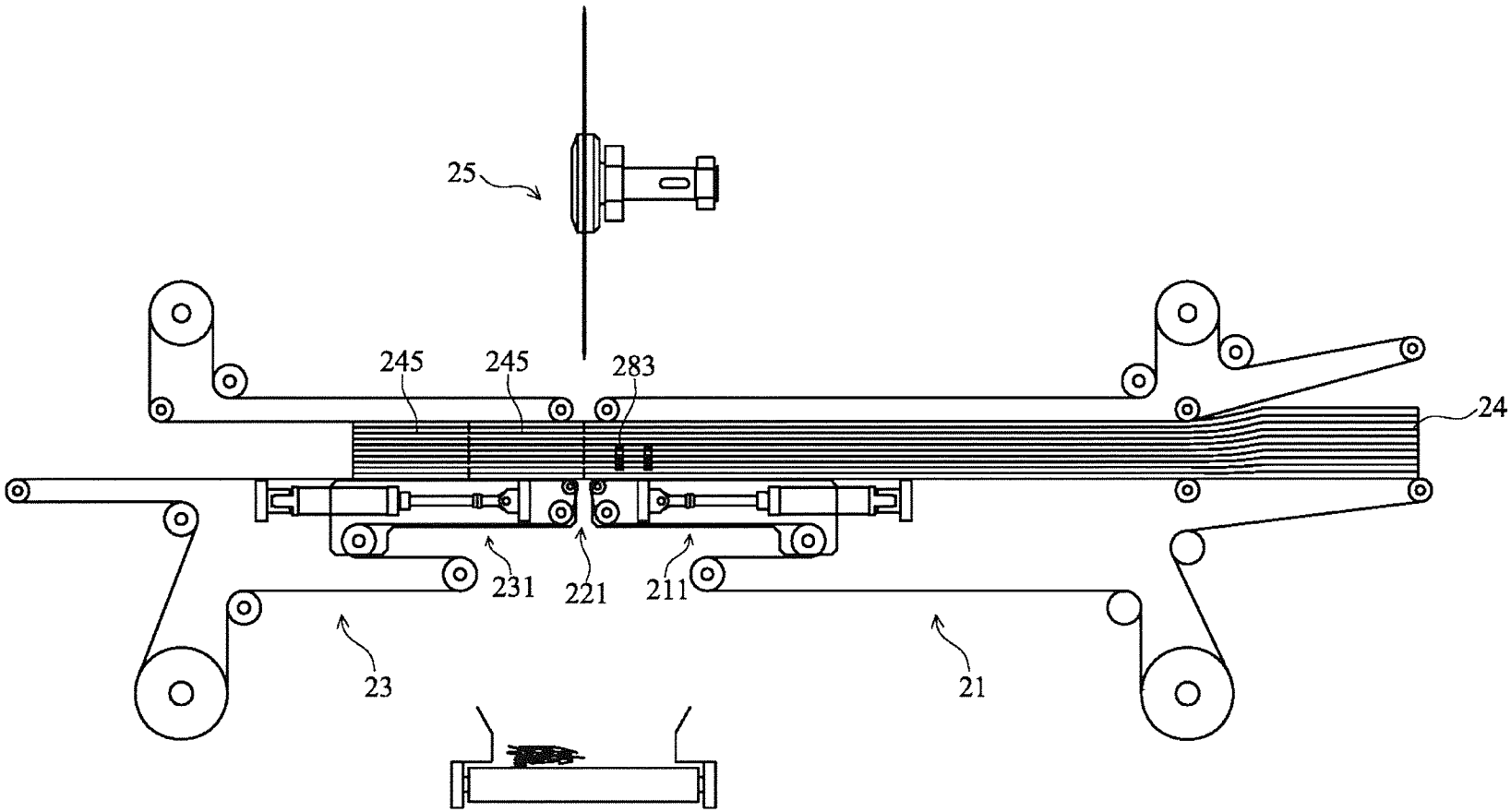

Referring to FIG. 6G, the cutter 25 is controlled to cut off the web product 24 again and again subject to the control of the second sensor unit 283, thereby producing multiple normal cut pieces 245. At this time, the first movable roller set 211 and the second movable roller set 231 are still kept in the conveying position so that the second conveying unit 23 can deliver every normal cut piece 245 over the first gap 221 onto the second conveying unit 23.

Figure 6H:
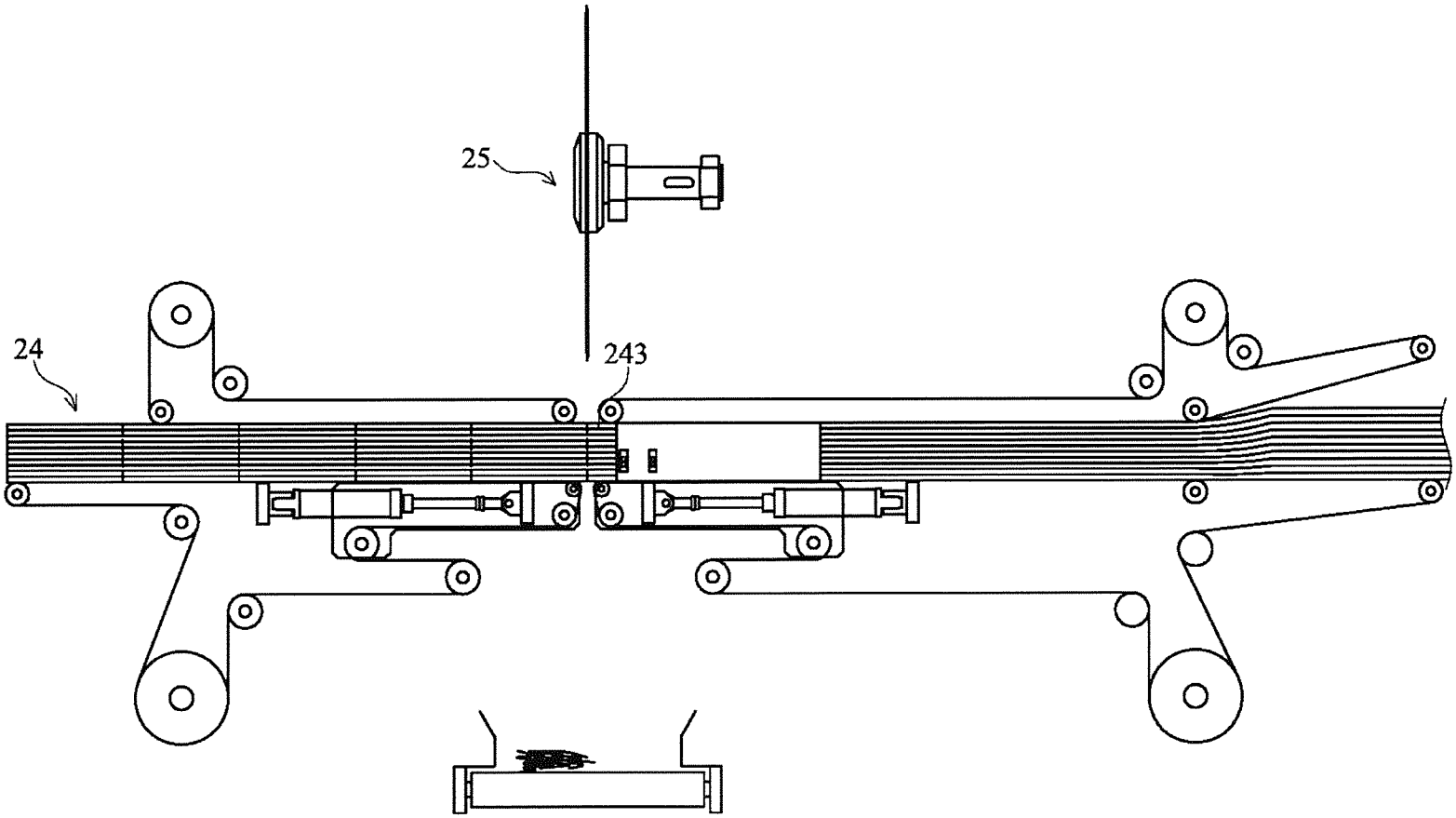
Figure 6I:
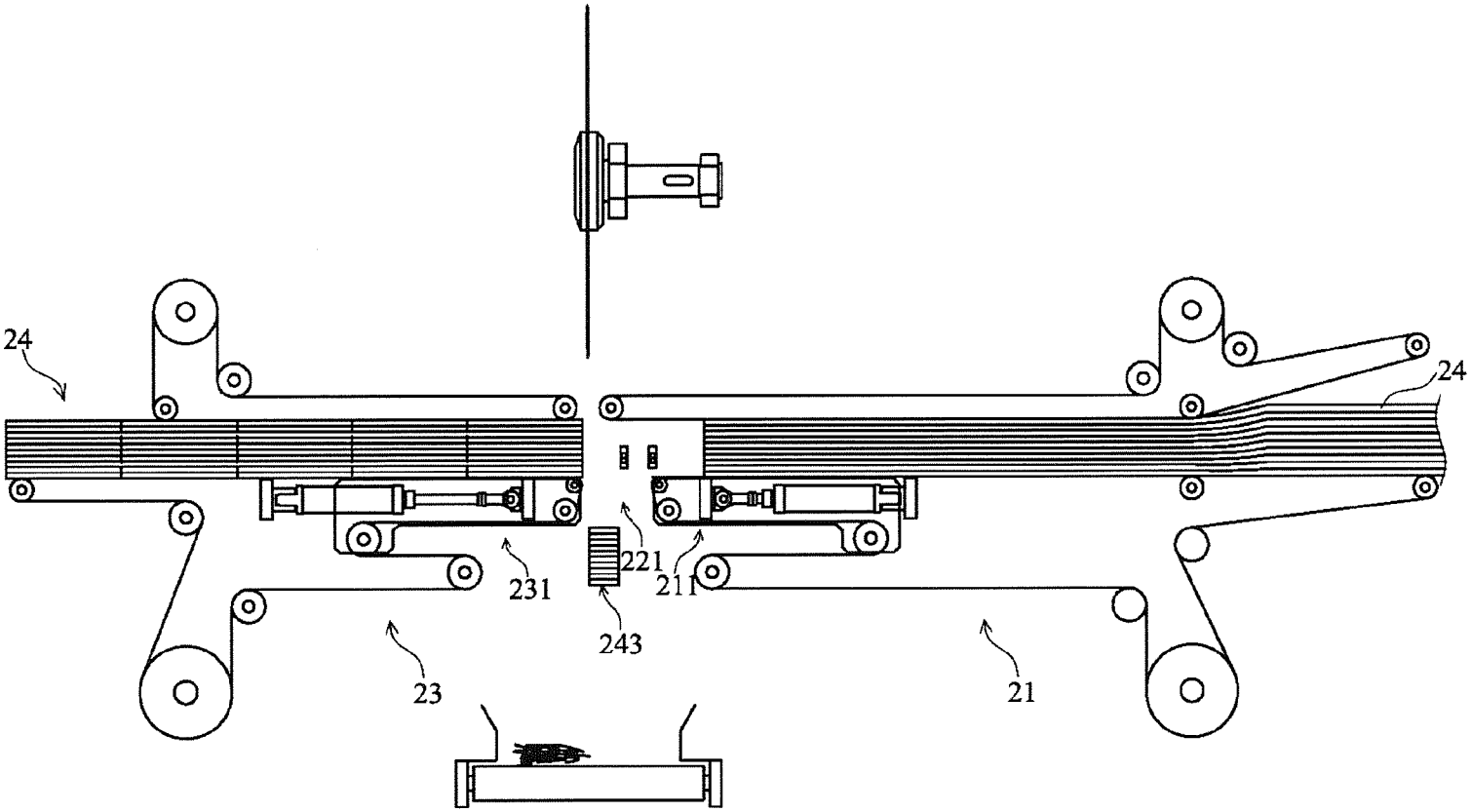

Referring to FIG. 6H, upon the last cutting operation of the cutter 25 to cut off the web product 24 in each web product cutting and screening cycle, a tail cut piece 243 is obtained. Thereafter, as shown in FIG. 61, the first conveying unit 21 and/or the first movable roller set 211 are retreaded from the conveying position in direction away from the second conveying unit 23 and/or the second movable roller set 231, for example, the first conveying unit 21 and/or the first movable roller set 211 are moved in the conveying direction to increase the width of the first gap 221, enabling the tail cut piece 243 to fall through the first gap 221.

Figure 6J:
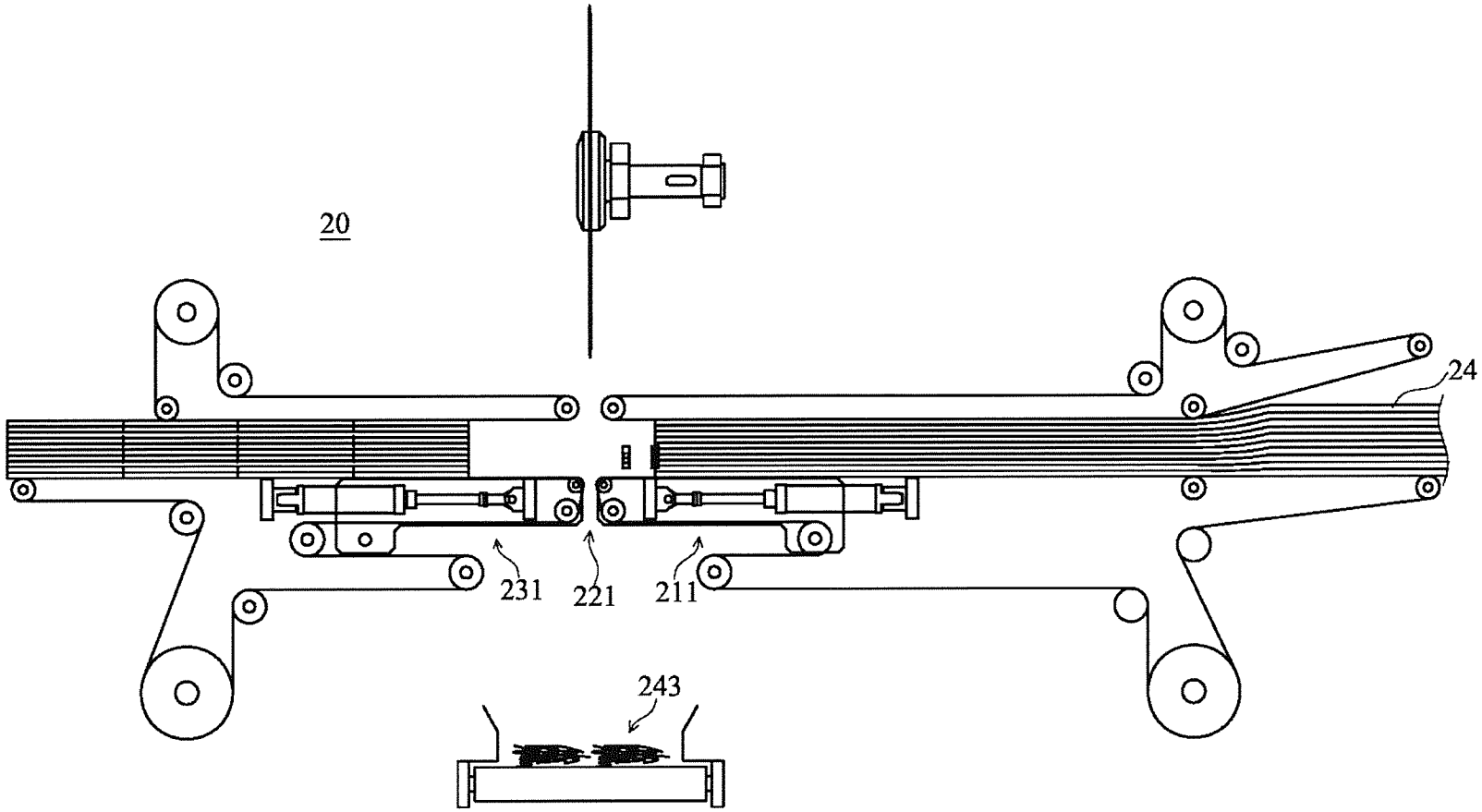

As shown in FIG. 6J, after falling of the tail cut piece 243 through the first gap 221, the first movable roller set 211 is moved toward the second movable roller set 231 to the conveying position, enabling the web product cutting and screening machine 20 to perform a next web product cutting and screening cycle. The web product cutting and screening cycle is repeated again and again to cut off multiple web products 24 and to screen the related cut pieces.

It is to be understood the invention is not limited to particular systems described which may, of course, vary. It is also to be understood that the terminology used herein is for the purpose of describing particular embodiments only, and is not intended to be limiting. As used in this specification, the singular forms "a", "an" and "the" include plural referents unless the content clearly indicates otherwise. Thus, for example, reference to "a device" includes a combination of two or more devices and reference to "a material" includes mixtures of materials.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A web product cutting and screening method, comprising the steps of:

moving a first movable roller set and a second movable roller set to a conveying position and enabling a web product to be delivered by said first movable roller set onto said second movable roller set over a first gap between said first movable roller set and said second movable roller set;

cutting off said web product in said first gap to produce a first cut piece;

moving said second movable roller set from said conveying position to a non-conveying position far from said first movable roller set for enabling said first cut piece to fall through said first gap;

moving said second movable roller set back to said conveying position and keeping said first movable roller set in said conveying position for enabling said web product to be delivered by said first movable roller set over said first gap onto said second conveying unit;

cutting off said web product in said first gap during delivery of said web product by said first movable roller set over said first gap onto said second movable roller set to produce at least one second cut piece and a third cut piece; and moving said first movable roller set from said conveying position to a non-conveying position far from said second movable roller set for enabling said third cut piece to fall through said first gap.

2. The web product cutting and screening method as claimed in claim 1, wherein first cut piece is a head cut piece that is a waste piece obtained from a leading part of said web product.

3. The web product cutting and screening method as claimed in claim 1, wherein the third cut piece is a tail cut piece that is a waste piece obtained from a tail end of said web product.

4. The web product cutting and screening method as claimed in claim 1, wherein each said second cut piece is a normal cut piece delivered by said first movable roller set over said first gap onto said second movable roller set and conveyed by said second movable roller set.

5. The web product cutting and screening method as claimed in claim 1, further comprising the step of moving said second movable roller set toward said first movable roller set to reduce the width of said first gap after falling of said first cut piece through said first gap.

6. The web product cutting and screening method as claimed in claim 1, further comprising the step of moving said first movable roller set back to said conveying position after falling of said third cut piece through said first gap.

7. The web product cutting and screening method as claimed in claim 1, further comprising the step of using a first sensor unit to detect passing of said web product and to control said first movable roller set to reduce the conveying speed.

8. The web product cutting and screening method as claimed in claim 1, further comprising the step of using a second sensor unit to detect passing of said web product, to define a start point of said web product, to count the length of said web product passing by, and to control the operation of cutting said web product subject to the counting result.

9. A web product cutting and screening machine operable to cut off a web product and to screen cut pieces of said web product, comprising:

a first conveying unit comprising a first movable roller set, wherein said first movable roller set is movable between a conveying position and a non-conveying position;

a second conveying unit comprising a second movable roller set disposed adjacent to said first movable roller set and defining with said first movable roller set a first gap therebetween, wherein said second movable roller set is movable relative to said first movable roller between said conveying position and said non-conveying position, and said web product is delivered from said first movable roller set in said conveying position to said second movable roller set in said conveying position; and a cutter movable to cut off said web product in said first gap, wherein after each cutting operation of said cutter to cut off said web product, said first movable roller set and said second movable roller set are selectively moved to one of the positions where said first movable roller set is in said conveying position and said second movable roller set is in said non-conveying position far from said first movable roller set, said first movable roller set and said second movable roller set are in said conveying position, or said first movable roller set is in said non-conveying position far from said second movable roller set and said second movable roller set is in said conveying position.

10. The web product cutting and screening machine as claimed in claim 9, wherein said cutter is movable to cut off said web product in said first gap to produce a head cut piece, and said first movable roller set is kept in said conveying position and said second movable roller set is moved from said conveying position to said non-conveying position to increase the width of said first gap after the production of said head cut piece, enabling said head cut piece to fall through said first gap.

11. The web product cutting and screening machine as claimed in claim 9, wherein said cutter is movable to cut off said web product in said first gap to produce a tail cut piece, and said first movable roller set is moved from said conveying position to said non-conveying position and said second movable roller set is kept in said conveying position to increase the width of said first gap after the production of said tail cut piece, enabling said tail cut piece to fall through said first gap.

12. The web product cutting and screening machine as claimed in claim 9, wherein said cutter is movable to cut off said web product in said first gap to produce at least one normal cut piece, and said first movable roller set and said second movable roller set are kept in said conveying position.

13. The web product cutting and screening machine as claimed in claim 9, further comprising a first top conveying unit spaced above said first conveying unit, and a second top conveying unit spaced above said second conveying unit, wherein a second gap is defined between said first top conveying unit and said second top conveying unit.

14. The web product cutting and screening machine as claimed in claim 13, further comprising a web product feed port between said first top conveying unit and said first conveying unit, wherein said web product feed port has a height gradually reducing in direction from said first conveying unit toward said second conveying unit.

15. The web product cutting and screening machine as claimed in claim 9, further comprising a first sensor unit adapted to detect said web product on said first conveying unit and to control said first conveying unit to reduce the conveying speed upon detection of said web product in said first conveying unit.

16. The web product cutting and screening machine as claimed in claim 15, further comprising a second sensor unit adapted to define a start point of said web product and to count the length of said web product passing by.

17. The web product cutting and screening machine as claimed in claim 9, further comprising a waste collection unit spaced below said first gap and adapted to collect a head cut piece and a tail cut piece cut from said web product by said cutter.

* * * * *